United States Patent [19]

Taub et al.

[11] Patent Number: 4,584,036

[45] Date of Patent: Apr. 22, 1986

[54] HOT WORKING OF AMORPHOUS ALLOYS

[75] Inventors: Alan I. Taub, Schenectady; Peter G. Frischmann, Scotia, both of N.Y.

[73] Assignee: General Electric Company, Schenectady, N.Y.

[21] Appl. No.: 657,329

[22] Filed: Oct. 3, 1984

[51] Int. Cl.[4] ..... H01F 1/00

[52] U.S. Cl. ..... 148/120; 72/200; 72/342; 72/364

[58] Field of Search ..... 148/120, 121, 122, 403; 72/200, 342, 364

[56] References Cited

U.S. PATENT DOCUMENTS

| | | | |
|---|---|---|---|
| 4,288,260 | 9/1981 | Senno et al. | 148/121 |
| 4,444,602 | 4/1984 | Makino et al. | 148/121 |
| 4,482,402 | 11/1984 | Taub | 148/121 |

FOREIGN PATENT DOCUMENTS

| | | | |
|---|---|---|---|
| 51-73923 | 6/1976 | Japan | 148/121 |
| 57-79158 | 5/1982 | Japan | 148/121 |

OTHER PUBLICATIONS

Scaling the Kinetics of Flow and Relaxation in Amorphous Alloys; Materials Science & Engineering, 62 (1984) 249–260, by A. Taub and J. Walter.

*Primary Examiner*—John P. Sheehan

*Attorney, Agent, or Firm*—Paul E. Rochford; James C. Davis, Jr.; James Magee, Jr.

[57] ABSTRACT

The problem of working an amorphous alloy is overcome by heating the alloy at a rate of temperature increase above a certain rate. The amorphous alloy is worked as its temperature is still being increased. Desirable magnetic properties of the alloy are preserved by working the alloy in this fashion and also tool life is extended.

9 Claims, 2 Drawing Figures

WHERE T = THE TEMPERATURE IN °K OF THE SPECIMEN BEING RAMPED, & $T_x$ = THE TEMPERATURE IN °K OF THE ONSET OF CRYSTALLIZATION AT 20°C PER/MINUTE.

WHERE T = THE TEMPERATURE IN °K OF THE SPECIMEN BEING RAMPED, &
$T_x$ = THE TEMPERATURE IN °K OF THE ONSET OF CRYSTALLIZATION AT 20°C PER/MINUTE.

HOT WORKING OF AMORPHOUS ALLOYS

CROSS REFERENCE TO RELATED APPLICATIONS

The present invention is related to the inventions disclosed and claimed in application Ser. No. 651,973, filed Sept. 19, 1984 and application Ser. No. 647,291, filed Sept. 4, 1984.

BACKGROUND OF THE INVENTION

The present invention relates generally to the working or forming of amorphous alloy materials which are difficult to work. More specifically, it relates to the cutting, slitting, rolling or stamping of amorphous alloys.

It is known that several working or forming operations performed on amorphous alloys such as cutting, slitting, rolling or stamping are operations which are difficult to perform when the material treated is at room temperature. The deformation of any material requires a flow of material as the material is formed or worked and at low temperatures the flow of amorphous alloys is governed by an inhomogeneous deformation mechanism. This deformation mechanism is characterized by high stresses and because of the high stresses the tools used in the forming operations have short useful lives. In addition, it is known that inhomogeneous deformation of amorphous alloys is detrimental to the soft magnetic properties of the alloys.

It has been known, heretofore, that some of the difficulties in forming the amorphous alloys can be overcome or reduced by performing the forming operations at elevated temperatures. This has been reported by Masumoto in Japanese patent application No. 132288, dated Nov. 5, 1976. In this publication, it is taught that forming processes should be applied to the amorphous alloy only at temperatures above the "ductile transition temperature" and this temperature is designated as $T_p$. The same temperature which has been regarded as critical for working has also been referred to as the "plastic transition temperature" in an article by Liebermann, in Mat. Sci. Eng. 46, 241 (1980). It is known that above this plastic transition temperature the amorphous alloys can be deformed at low stresses to a high degree of straining. Patterson et al reported the hot forming of a metallic glass and demonstrated this hot forming by drawing a cup from a ribbon of amorphous alloy. This is reported in J. Patterson, A. L. Greer, J. A. Leake and D. R. H. in "Proceedings Third International Conference on Rapidly Quenched Metals", (Chameleon Press, 1978), p. 293.

More recently, Homer and Eberhardt produced strains approaching 100% in an amorphous alloy ribbon of PdFeSi at stresses as low as 150 Mpa by a deformation which was carried out at high temperatures. This was reported in Scripta Met. 14, 1331 (1980).

In none of the foregoing studies and methods developed from the studies was there any concern with the effect of the rate of heating of the article to be formed on the forming of the amorphous article. Primary consideration of this prior art work was the consideration of the crystallization kinetics of the alloy. An object was to effect the working without imparting significant degrees of crystallinity to the product. In this way it was sought to retain the amorphous character of the article which was being formed. The avoidance of crystallization is a primary consideration in preserving the properties of the amorphous alloys.

We have succeeded in discovering a relationship between the softening and increase in workability of an amorphous alloy article and the heating rate or the rate at which the article is undergoing heating. It is important to distinguish between the heating history of the article, that is the heating to a certain temperature prior to working or the rate at which an article has been heated to attain a certain temperature prior to working, and the effect which we have found to be important, namely the rate at which an article is being heated at the very time the working or forming of the article is taking place. We have found that an article such as an amorphous alloy undergoes a softening when and, more specifically, during the time when it is undergoing the heating at a relatively high heating rate. Further, we have succeeded in determining the variation of the softening temperature with or as a function of the heating rate in a quantitative manner.

BRIEF STATEMENT OF THE INVENTION

It is, accordingly, one object of the present invention to provide an improved method by which amorphous alloys may be deformed or otherwise worked.

Another object is to provide novel articles which result from their being worked as they are being heated.

Another object is to provide a method which makes possible the attainment of processing of amorphous alloys at temperatures below the "ductile transition temperature" or "plastic transition temperature" by the use of a high heating rate and continuous heating.

Other objects will be in part apparent and in part pointed out in the description which follows.

In one of its broader aspects, objects of the present invention can be achieved by first providing an amorphous alloy to be worked. The next step is to subject the amorphous alloy sample to a rapid rate of heating. The third step is to subject the article to stress to work the article while the temperature of the portion of the article which is stressed is still being increased and during the time that the rate of heating of the article is relatively high.

While the Applicants do not wish to be bound by the theory, an explanation of the mechanism of the phenomena which is the basis for preservation of desirable magnetic properties in an amorphous alloy which has been worked in accordance with the practice of the present invention is offered here for assistance to those seeking to preserve such desirable magnetic properties.

If a stress is applied to an amorphous alloy sample, the mode in which deformation occurs as a result of the applied stress is significant to the magnetic properties of the deformed sample. Such alloy samples may deform either in a discrete and inhomogeneous manner if the measures used in the deformation don't conform to those provided by the present invention, or it may deform in a uniform and homogeneous manner if the deformation is carried out pursuant to the present invention. Inhomogeneous deformation is believed to be responsible for deterioration of magnetic properties of the deformed sample as compared to the properties prior to deformation.

We have discovered that there is a critical value for the stress to be applied to an amorphous alloy sample in order to deform it homogeneously and preserve good magnetic properties. We believe that the critical stress value is close to or approximately at the yield strength of an amorphous alloy sample. We believe that if the stress which is applied to deform the sample is less than the critical stress then uniform deformation or homogeneous deformation can be achieved and the magnetic properties of the deformed sample can be preserved at their maximum for a deformed sample. On the contrary, if the stress applied is greater than the critical stress or greater than the yield strength of the sample, then discrete or inhomogeneous deformation will occur and deterioration of magnetic properties results.

It is also our finding based on our understanding of the mechanism of deformation that it is feasible to extend and preserve useful tool life, such as die life, by applying less than the critical stress in carrying out the deformation.

BRIEF DESCRIPTION OF THE DRAWINGS

The explanation of the invention which follows will be made clearer by reference to the accompanying drawings in which.

DETAILED DESCRIPTION OF THE INVENTION

Figure 1:
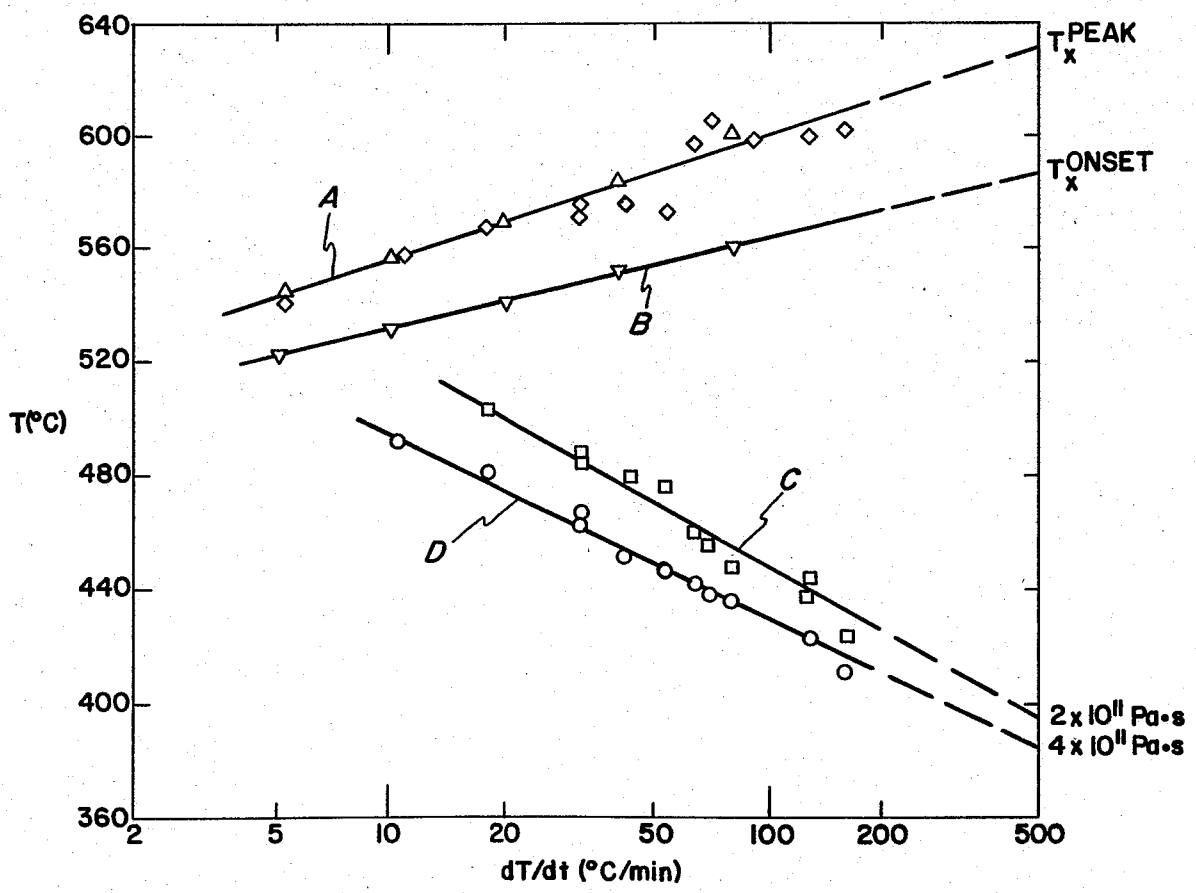
FIG. 1 is a graph illustrating the temperature in °C. as the ordinate and the rate of heating in °C. per minute as the abscissa, and demonstrating that the softening temperature, Ts, decreases with increase in the rate of heating and that also the temperature for crystallization, Tx, increases with increasing rate of heating. This figure also evidences that the effect of increasing the rate of heating is to widen the operating window between the soft state (lower lines of the Figure) of an amorphous alloy article and the crystallizing state (upper lines of the Figure) of the alloy.

We have found that when an amorphous alloy sample is held at its softening temperature or is held isothermally at any temperature above the softening temperature, the viscosity or the flow resistance of the amorphous alloy increases significantly with time. In other words, the amorphous alloy begins to harden. We have found that the hardening occurs at a rate approximately equal to $10^9$ to $10^{10}$ Pa-s/s, or Pascals seconds per second. Further, we have found that the value of the rate of hardening or rate of increase in viscosity can be determined quantitatively if the particular heating rate and holding temperature for a particular sample are known. If the softening temperature is considered to be the temperature at which the viscosity equals approximately $10^{10}$ Pa-s, then holding the sample isothermally for times greater than about 1 second hardens the alloy out of its softer state and into a harder state.

We have learned that this hardening effect can be overcome if the alloy is continuously heated during the entire forming operation. To put this an other way, we have learned that if the forming operation is performed while the amorphous alloy is continuously undergoing heating at a substantial rate, then the net hardening which otherwise occurs instead does not occur but rather the amorphous alloy retains its ability to be worked in an apparent "soft" state.

To practice the present invention and to work or form an amorphous alloy, the alloy sample deformed should be heated in a controlled manner to ramp its temperature, that is to increase its temperature at a given rate of increase. When the alloy sample has reached a temperature T which is greater than the softening temperature, Ts, the forming operation should be initiated. It has been found that it is critical to the practice of the invention that the ramping of the temperature of the sample should be continued during the forming operation. Further, if it is desired to avoid crystallization of the sample following the working operation, it is advisable to subject the sample to a fast cool-down after the forming is completed in order to avoid such crystallization.

In other words, we have found that by increasing the temperature of the sample during the forming operation, there is, in effect, a counteracting of the "hardening" process which otherwise occurs. Because of the continued ramping of the temperature of the sample during the forming, the amorphous alloy is maintained in a soft state. This effectively opens the "working window" for amorphous alloys in that it permits the deformation of the amorphous alloys in a wider range of processing parameters.

EXAMPLE 1

A sample of an amorphous metal ribbon and particularly a sample of a 1" wide ribbon of an iron boron silicon composition, specifically $Fe_{78}B_{13}Si_9$, was obtained from the Allied Corporation and was mounted in an Instron tensile testing apparatus. The ribbon itself was mounted to extend at its midsection through a furnace having a well-controlled temperature. In this first example, the teachings of Masumoto, as discussed above, were first considered. The portion of the sample in the furnace was ramped in temperature to a temperature above the softening temperature for the particular rate of heating employed. The ramping of the temperature was stopped and the temperature was held constant and the crosshead of the Instron was activated to exert tensile force on the sample. It was observed that the load which was required to deform the amorphous alloy increased linearly with time. This verified that a hardening of the amorphous alloy sample was in progress during the time when the temperature of the sample was held constant although it had already been heated to a temperature above its softening temperature.

In this specific example, a specimen was heated and the temperature was ramped at 123° C./minute until the specimen reached a temperature of 515° C. At that time, and at that temperature, the ramping of the temperature was stopped and the temperature was held constant. The crosshead motion on the Instron frame was then initiated to give a motion rate of 100 mil/minute. Within 30 seconds the stress required to deform the heated specimen changed from approximately 4 Mpa to approximately 50 Mpa.

EXAMPLE 2

The procedure of Example 1 was repeated but in this case the motion of the Instron crosshead was started without having terminated the ramping of the specimen temperature. Instead, the temperature was continuously ramped during the deformation. It was discovered that the amorphous alloy sample maintained the same rate of elongation at a nearly constant stress value of 5 Mpa.

EXAMPLE 3

The procedure of Example 2 was repeated but in this case the rate of movement of the crosshead was increased to the highest value at which the Instron can be made to operate, namely at 2 inches per minute. This is a strain rate equal to about 20%/minute. It was found that the stress required in order to maintain constant deformation as the temperature ramping of the sample was continued was only 88 Mpa.

EXAMPLES 4–46

In this series of examples, an effort was made to define a preferred set of operating conditions for use in the practice of the present invention. The results of this study are included as data points in the graph of FIG. 1. In FIG. 1, the temperature in °C. is plotted as the ordinate and the ramping rate, that is the rate at which temperature is changed with time is plotted as a logarithmic function as the abscissa. Forty two data points are included on the graph, one point for each example. The upper diagonal line A of the graph extends through data points which represent values derived from both flow studies and calorimetry studies.

Only calorimetric studies were made to establish line B which represents the line of points at which crystallization starts to occur.

The upper line A, represents the series of points at which the rate or crystallization becomes a maximum.

Generally speaking, it is preferred to operate in parametric values i.e. at a temperature value (ordinate) and at a temperature ramping value (abscissa) below the line B of the Figure.

By way of example, if a ramping rate of 50° C. per minute is selected on the abscissa scale, then it will be evident from the figure that the straining of the sample pursuant to the present invention should be made below about 550° C. This is the value on the ordinate which corresponds to the ramping rate of 50° C. per minute as the abscissa, i.e. where the 50° C. per minute rate intercepts line B. Accordingly, since the preferred working temperature is below the value found on line B, then the working must certainly be done below the temperature at which crystallization rate is a maximum as obtained from line A of the graph. Such peak crystallization temperature is about 585° C.

In other words, to practice the present invention it is required that a certain ramping rate be applied to increase the temperature of the piece to be worked but it is also necessary that the working or straining of the piece or specimen be accomplished at a temperature which is below the temperature of onset of crystallization as represented by line B of FIG. 1.

Accordingly, the foregoing describes the upper temperature at which the straining of the sample should be initiated to derive the benefits of the present invention.

Of course, it will be understood that there is also a lower temperature at which the straining should be initiated and this lower temperature can be found by reference to the set of two lines, line C and line D, at the lower part of FIG. 1.

What has been discovered is that to practice the present invention the preferred conditions are attained when the specimen which is being ramped is subjected to straining at a temperature above a minimum temperature also derivable from FIG. 1.

Returning to the illustration given above for a sample which is being ramped at 50° C. per minute while being subject to straining, reference is made again to FIG. 1. It is evident from the figure that at a ramping rate of 50° C. per minute, the minimum temperature at which straining should be performed is found as the intercept of the line for ramping at 50° C. per minute with line D. This temperature is about 445° C. Also, the preferred temperature at which a sample being ramped at 50° C. per minute should be strained is found as the intercept of the line for ramping at 50° C. per minute with line C. This value is about 470° C. The temperatures are read from the ordinate scale of FIG. 1.

As another illustration from FIG. 1 if a 20° C. per minute ramp rate is employed then there is a smaller temperature window in which the straining of the sample should be initiated in order to stay within the scope of the present invention. Similarly, if the ramping temperature is 100° C. per minute than from FIG. 1 there is a still larger temperature window in which the straining of a sample being heated at a ramping rate of 100° C. per minute is being accomplished.

The lower lines C and D, of FIG. 1 are derived from viscosity considerations and an explanation is given now of the basis on which these viscosity values are derived. The lowermost line, D, of FIG. 1 represents a viscosity value of $4\times10^{11}$ Pa-s (pascal-seconds). The upper of the two viscosity based lines, line C of FIG. 1, represents a viscosity value of $2\times10^{11}$ pascal-seconds. The pascal-seconds units are units of viscosity measurement and in this sense are similar to the value given in poise units in other systems. In fact, one pascal-second is equal to 10 poise.

Turning now to the tests which were conducted in obtaining the data which defines the lower temperature at which straining should be initiated and how the straining temperature relates to the ramping rate the following details are offered.

In this series of tests, amorphous alloys as referred to in Examples 1, 2 and 3 above were ramp heated at a ramping rate of dT/dt. The ramping rate is indicated as the abscissa of FIG. 1. The ramping was done under a constant load, herein identified as p, which was applied to the test specimen on a continuous basis during the period of the test. During the test, the deformation rate was monitored as a function of temperature. The data points for the two lower lines of FIG. 1 were obtained from these tests. For these tests the deformation rate $\epsilon$ has been converted to a measure of viscosity designated as $\eta$ by normalizing. The applied stress is designated as $\sigma$.

$$\sigma=P/A$$

where A is the cross-sectional area of the ribbon being stressed.

The viscosity, $\eta$, is a measure of the flow resistance of the material of the specimen being rampled.

$$\eta=\tfrac{1}{3}\,\sigma/\epsilon$$

Referring again now to FIG. 1, it is important to observe that the conditions which are prescribed for carrying out the process of the present invention can both be found from FIG. 1. The value in °C./min. of the rate of ramping of the sample is found from the abscissa and the temperature at which the working should be performed is found from the values of the ordinate. It has been found possible to accomplish a homogeneous working of the amorphous alloy specimen employing the conditions described in FIG. 1.

With relation to homogeneous working of the sample, it is known in the field of metal working that the material being worked is strained at a rate on the order of 1 inch per inch per second. As an example of this rate, if a sample is initially 5 inches long and it is subjected to a deformation rate of 1 inch per inch per second, it will becomes 10 inches long at the end of 1 second.

It has been found that in order to maintain good magnetic properties, the alloy must be able to be deformed homogeneously at at least this rate, i.e., at a rate of 1 inch per inch per second. Further, this homogeneous deformation requires that the applied stress be less than about the yield strength of the amorphous alloy. This critical stress is about $10^{11}$ Pa.

Accordingly, the viscosity $\eta=\frac{1}{3}\ \sigma/\epsilon$, must be less than about $10^{11}$ Pa-s.

Accordingly, the homogeneous deformation of an amorphous alloy can be accomplished by applying a ramping rate to bring the sample to a temperature which is within the designated areas of FIG. 1 between lines B and D. A preferred range is within the region of FIG. 1 between lines B and C.

It is emphasized that this homogeneous deformation can be accomplished only if the temperature is ramped as the sample is deformed. The upper level of working temperature is also evident from FIG. 1. From this figure it is evident that the working temperature cannot be greater than that shown by the line B of FIG. 1 and this is the temperature at which crystallization is initiated. If deformation is carried out at higher temperatures, then the magnetic properties of the sample degrade due to the crystallization of the sample.

Further, as is noted above, it is evident from the figure that the higher the ramping rate, the greater the temperature range over which homogeneous deformation can be accomplished. Conversely, it is evident from the figure then if the ramping rate is below 10° C. per minute, that the sepcimen does not enter the designated sections of the figure and no homogeneous hot working is feasible.

The foregoing Examples 4–46 are specific to an alloy of FeBSi and particularly to an alloy identified as a 1" wide ribbon of $Fe_{78}B_{13}Si_9$.

However the method of the present invention is not limited to this specific alloy but is useful in connection with a wide range of amorphous alloy strips and wires.

Figure 2:
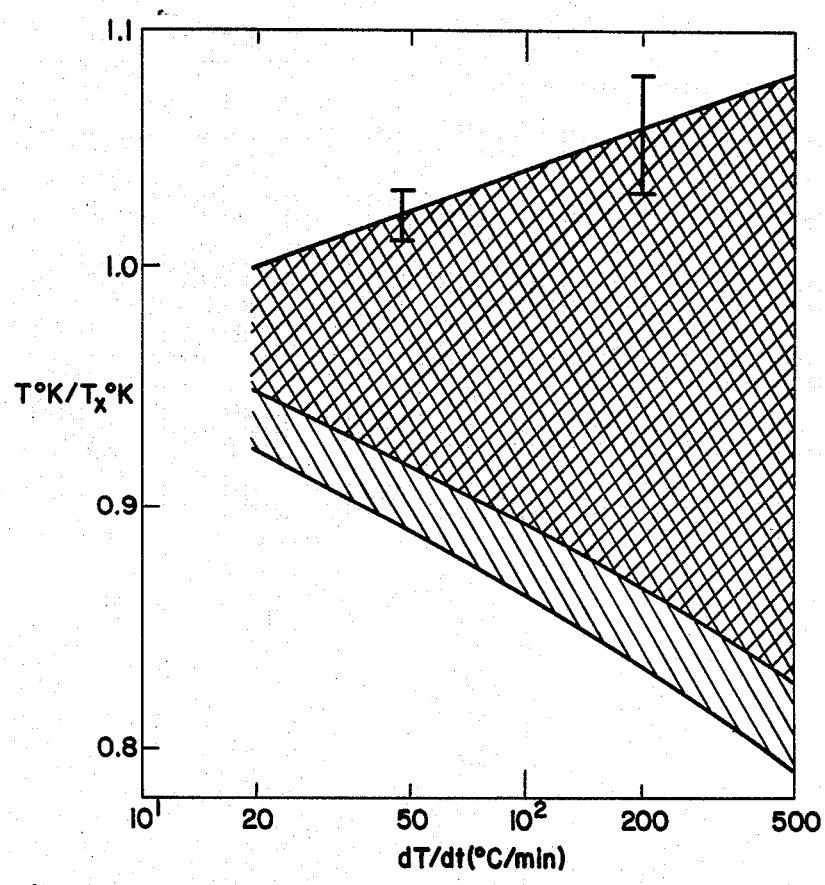
FIG. 2 is a graph which is similar to FIG. 1 but which is normalized to present a broader scope of the invention in a graphic illustration.

As a means of expressing this broader scope of the invention the data as presented in FIG. 1 has been generalized and has been presented in FIG. 2.

In FIG. 2 the ratio of the temperature, T, in °K. to the temperature of the onset of crystallization, as measured calorimetrically at 20° C./mm, and reported as $T_x$ in °K., is plotted against the ramping rate dT/dt in °C. per minute.

We have established that the relationship expressed by the graph of FIG. 2 is valid for the working of a broad range of amorphous alloys.

We have established that the flow and viscosity parameters for all amorphous alloys can be reduced to the master curves as presented in FIG. 2. These curves are derived by normalizing the curves for individual alloy systems such as is presented in FIG. 1. The normalizing is accomplished by expressing the specimen temperature as a ratio of its actual temperature in °K. to the temperature, Tx, for the onset of crystallization for the amorphous alloy system under study. The temperature, Tx, for onset of crystallization is that determined by differential scanning calorimetry at 20° C./min.

FIG. 1 presents the temperature of a sample being ramped in °C. as the ordinate of the graph whereas FIG. 2 presents the temperature of a sample being ramped as the ratio of the temperature in °K. to the temperature, Tx, of the onset of crystallization in °K. for the particular amorphous alloy being ramped. The graph of FIG. 2 has been established as a master graph for all amorphous alloys. Approximate error bars are impressed on the upper line of the graph of FIG. 2. This upper line represents the temperatures for the onset of crystallization for the different ramping rates designated along the abscissa. The error bars illustrate the variation in the temperatures of onset of crystallization which are due to compositional variations of crystallization behavior.

In practicing the invention, and with reference now to FIG. 2, the coordinates of ramping temperature as presented on the abscissa and the temperature ratio as presented on the ordinate which in combination permit the desirable magnetic properties of an amorphous alloy to be retained, are those found within the hatched area of FIG. 2 and between the upper and the lowermost line on the graph.

The graph of FIG. 2 includes ramping temperatures up to 500° C. per minute. It will be understood however that the method operates for ramping temperatures above 500° C. per minute within ranges of coordinates which lie within extensions of the lines of FIG. 2 to ramping temperatures of 1000° C. per minute and higher.

Further for amorphous alloys which have been given an anneal prior to practice of the present invention, the relationships established and plotted in FIG. 2 remain valid but the lower line of the graph will be shifted upward. The degree of shift will increase with increase in the degree of pre-anneal.

What is claimed and sought to be protected by Letters Patent of the United States is as follows:

1. A method of forming an amorphous alloy without destroying its magnetic properties which comprises
   providing an amorphous alloy specimen,
   ramping the temperature of the specimen at a rate which preserves its viscosity at a low value,
   heating the specimen to above its softening temperature,
   continuing to ramp the temperature above the softening temperature but below the crystallization temperature as the specimen is stressed, and
   stressing the specimen at or below its yield strength to strain the specimen while the temperature is being ramped.

2. A method of forming an amorphous alloy without destroying its magnetic properties which comprises
   providing an amorphous alloy specimen,
   ramping the temperature of the specimen at a rate dT/dt which can bring the temperature ratio $T°K./T_x°K.$, to within the hatched area of the graph of FIG. 2,
   continuing to ramp the temperature while the coordinates of the ramping rate and temperature ratio are within the hatched area of FIG. 2, and
   stressing the specimen at or below its yield strength to strain the specimen while the temperature is being ramped.

3. The method of claim 2 wherein the coordinates are within the cross hatched area of FIG. 2.

4. The method of claim 2 in which the coordinates are extrapolated to heating rates above 500° C./min.

5. The method of claim 3 wherein the coordinates of the cross hatched area of FIG. 2 are extrapolated to heating rates above 500° C./min.

6. The method of claim 1 in which the alloy is the composition $Fe_{78}B_{13}Si_9$, the ramping rate is about 20°

C. per minute and the onset working temperature is about 520° C.

7. The method of claim 1 in which the alloy is the composition $Fe_{78}B_{13}Si_9$, the ramping rate is about 40° C. per minute and the onset working temperature is between 480° C. and 540° C.

8. The method of claim 1 in which the alloy is the composition $Fe_{78}B_{13}Si_9$, the ramping rate is about 70° C. per minute and the onset working temperature is between 460° C. and about 560° C.

9. The method of claim 1 in which the alloy is the composition $Fe_{18}B_{13}Si_9$, the ramping rate is about 100° C. per minute and the onset working temperature is between about 440° C. and 560° C.

* * * * *